United States Patent [19]

Austin

[11] 3,989,604

[45] Nov. 2, 1976

[54] METHOD OF PRODUCING METAL STRIP HAVING A GALVANIZED COATING ON ONE SIDE

[75] Inventor: Lowell W. Austin, Weirton, W. Va.

[73] Assignee: National Steel Corporation, Pittsburgh, Pa.

[22] Filed: Oct. 15, 1975

[21] Appl. No.: 622,482

[52] U.S. Cl. ..... 204/28; 204/206; 204/211; 204/268; 204/DIG. 7

[51] Int. Cl.[2] ..... C25D 3/22; C25D 7/06; C25D 5/02

[58] Field of Search ..... 204/15, 28, 206, 208, 204/211, 268, 254, 146, DIG. 7, 228

[56] References Cited

UNITED STATES PATENTS

| | | | |
|---|---|---|---|
| 1,798,391 | 3/1937 | Wurth | 204/DIG. 7 |
| 2,655,473 | 10/1953 | Lowenheim | 204/268 |
| 2,673,836 | 3/1954 | Vonada | 204/28 |
| 3,178,305 | 4/1965 | Ward | 204/146 |
| 3,429,787 | 2/1969 | Weinreich | 204/268 |
| 3,901,771 | 8/1975 | Froman | 204/268 |

*Primary Examiner*—T. M. Tufariello

*Attorney, Agent, or Firm*—Shanley, O'Neil and Baker

[57] ABSTRACT

A method for producing galvanized metal sheet or strip material having a zinc coating on one side only. The method includes utilizing the strip as a bipolar electrode and electrolytically removing a zinc coating from one side of the strip while simultaneously depositing a substantially equivalent amount of zinc on the opposite side of the strip. The method is most economically performed with a steel strip having a differential coating of zinc.

21 Claims, 2 Drawing Figures

METHOD OF PRODUCING METAL STRIP HAVING A GALVANIZED COATING ON ONE SIDE

BACKGROUND OF THE INVENTION

This invention relates to a method for producing galvanized metal sheet or strip material having a zinc coating on one side only. More particularly, this invention relates to a method for treating zinc-coated metal strip or sheet material so as to remove the zinc coating from one side thereof while simultaneously depositing a substantially equivalent amount of zinc on the opposite side.

The use of galvanized metal sheet or strip material is conventional in many applications where corrosion resistance is important. However, in some cases, particularly when used in automobile body construction and the like, it is undesirable to have a zinc coating on both sides of the metal sheet or strip since such a coating has an undesirable effect on the weldability and surface finishing of the metal. In such instances it is important to provide a material having a galvanized surface on one side of the metal sheet, which side is generally unprotected otherwise, and a clean surface on the opposite side for efficient weldability and cosmetically acceptable surface finishing, such as painting.

Efforts to provide such galvanized sheet metal in the past have taken many forms including, for example, that of U.S. Pat. No. 2,894,850 to Green. Green describes a process which, in effect, includes masking one side of sheet metal with an aluminate coating to prevent the adherence of zinc thereto. U.S. Pat. No. 3,178,305 to Ward in part describes a process for electrolytically stripping one side of a zinc coated steel strip to provide a galvanized product having a zinc coating on one side only, but the strip itself is made anodic and the stripped zinc becomes deposited on the cathode. No provision is made for simultaneously depositing an equal amount of zinc onto the opposite side of the treated strip.

SUMMARY OF THE INVENTION

It has now been discovered that zinc-coated metal sheet or strip material may be treated so as to remove the coating from one side thereof by an electrolytic method which includes passing the material through an electrolytic solution and between separate cathode means and anode means so that the coating opposite the cathode means is removed from the metal base and an amount of zinc substantially equal to that removed is simultaneously deposited on the opposite side of the material. Thus, in such an arrangement, the sheet or strip material functions as a "bipolar" electrode. This method is particularly applicable in treating differentially zinc-coated material wherein the thickness of the zinc coating on one side is less than the thickness of the zinc coating on the opposite side. In treating such material the strip will be passed through the electrolyte so that the side having relatively thinner coating faces the cathode means and the opposite side faces the anode means.

Accordingly, it is a primary object of this invention to provide an efficient and economical process for producing galvanized metal sheet or strip material having a zinc coating on one side only.

It is a further object of this invention to provide a method for simultaneously removing a zinc coating from one side of a metal sheet or strip and depositing a substantially equivalent amount of zinc on the opposite side of said sheet or strip.

These and other objects and advantages of this invention will be developed in the following detailed description of the invention, reference being made to a preferred embodiment thereof and to the accompanying drawings which diagrammatically illustrate various forms of apparatus which are suitable for carrying out the invention.

DETAILED DESCRIPTION OF THE INVENTION

Figure 1:
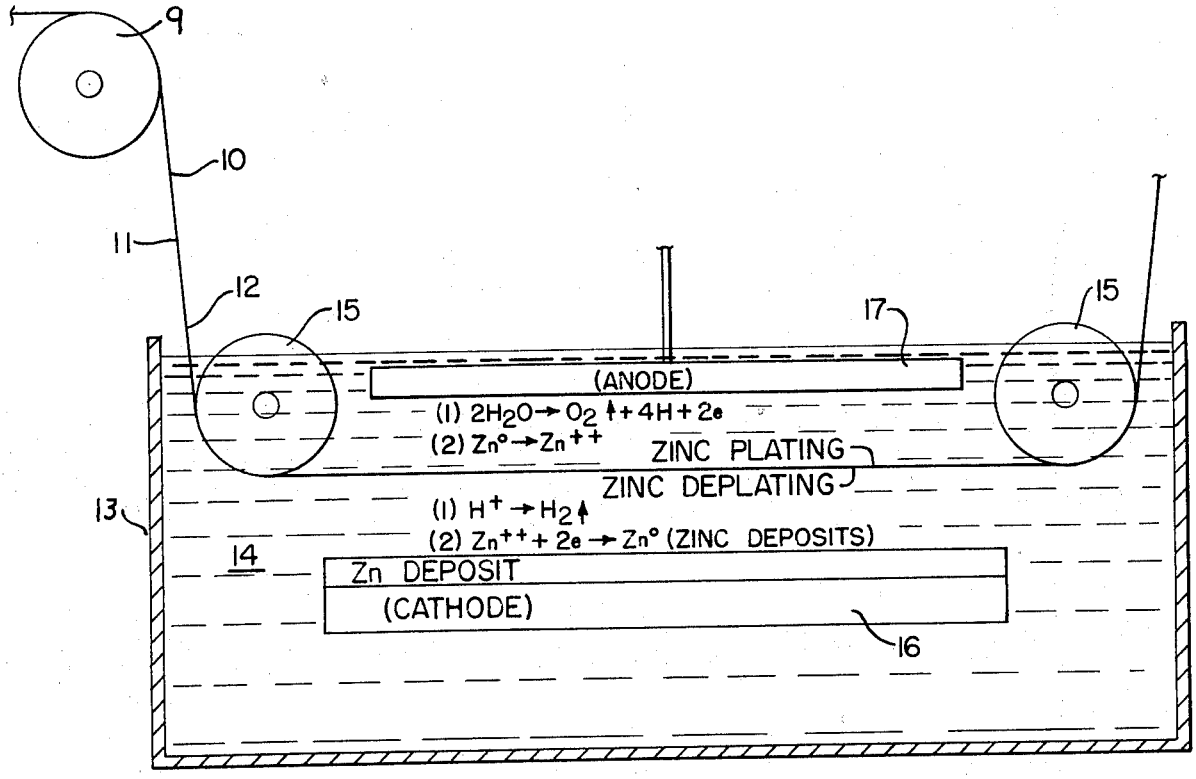
FIG. 1 is a diagrammatic vertical section through an apparatus adapted to carry out the present invention, including an illustration of the reaction mechanisms involved therein.

According to this invention, zinc-coated metal strip or sheet material is electrolytically treated to produce a galvanized product having a zinc coating on one side only, the other side being uncoated for maximum weldability and surface finishing. As used hereinafter the term "strip" should be construed as including sheet material. In its broadest sense the method of this invention comprises immersing a metal strip (coated on both sides with a zinc layer) in an electrolytic solution so that it passes between separate cathode means and anode means within the solution, thus functioning as a bipolar electrode, the result of which is the removal of the zinc coating from the side of the metal strip adjacent the cathode means while a substantially equivalent amount of zinc is simultaneously plated onto the opposite side of the strip, i.e. that adjacent the anode means.

The metal strip to be treated, preferably a steel strip 6 to 72 inches wide, may be hot-dipped or coated in any desired manner but in any event, it is coated on both sides with a zinc layer. In order to limit the time and current required to remove the zinc coating from one side of the strip it is preferred to have a differentially coated strip, i.e. having the lowest coating weight economically practicable on one side. This differential coating may be accomplished by any conventional method but the most convenient and preferred method is that disclosed in U.S. Pat. No. 3,499,418. Such a product will generally have a zinc coating on one side which is about 0.1 ounce/ft$^2$ or less, in general 0.01 – 0.15 ounce/ft$^2$ and a thicker coating on the opposite side, normally 0.2 – 0.7 ounce/ft$^2$. Of course where desired coated strip having a very light coating on both sides can be produced by the apparatus of U.S. Pat. No. 3,499,418. The strip material may be provided in its commercially acceptable coil form or it may be introduced into the system adapted to carry out the present invention directly from a metal coating line.

The strip is passed into a tank of conventional design and immersed in an electrolyte formed of a relatively low acidic solution generally having a pH within the range of 1.0 – 3.0. In the preferred case, the electrolyte comprises an aqueous solution of zinc sulfate and sulfuric acid and may contain conventional additives such as minor amounts of aluminum sulfate, magnesium sulfate and sodium sulfate, the latter compounds providing improved conductivity and a "whiter" deposit. Usually, zinc sulfate will be added in an amount which provides between about 10 – 20 ounces of zinc metal per gallon of electrolyte at a pH range of from about 1.0 – 4.0. The electrolyte will generally be maintained at a temperature within the range of about 120° to 150° F with a preferred temperature being 135° F.

When immersed in the electolytic solution the strip will be passed between a cathode means and anode means so that there is a spacing of about 1 to 3 inches, preferably about 2 inches, between the strip and each electrode. For maximum effectiveness, average current densities on the strip, i.e., bipolar electrode, within the "shadow" of the external electrodes, i.e., cathode means and anode means, should be between about 200 to 1,000 amps/ft$^2$. A current density of about 500 amps/ft$^2$ is preferred.

The strip is preferably passed between the electrodes at a line speed of from 100 to 500 feet per minute or higher depending on the length of the tank. The electrolyte is circulated within the tank and, preferably, directed towards the strip so as to minimize turbulance within the tank.

In some instances it will become necessary to increase voltage in order to offset a polarization type effect presumably caused by a lack of movement in the ions emanating from the strip being treated. Under such circumstances there is a need for a greater circulation to redistribute the ions in solution and this increase in circulation may be accomplished by any conventional means. Also, if there in insufficient circulation, burned areas form on the strip initially at the edges since the current densities are higher there.

The cathode means utilized in the invention is generally a good conductor which does not react with the electrolyte and is preferably made of a material which will not plate out zinc on its surface or at least resists the plating of metal ions tending to discharge on its surface. In either case, the cathode means will discharge hydrogen ions. Alternatively and less preferably but more practically, the cathode means is made of a material from which the zinc ions discharge to form a deposit which can be easily stripped therefrom. Zinc may also be removed from the cathode by reversing the polarity and turning the strip (providing the electrodes are of the same material) whereupon the zinc plating will dissolve in the electrolyte.

Specific examples of materials used as anodes and cathodes in this invention are lead and lead alloys, carbon, platinum plated titanium and aluminum.

It is preferred, although not necessary to the invention, to remove dissolved iron periodically from the electrolyte. This is preferably carried out by an oxidation process, for example with zinc peroxide or manganese dioxide to ferric and precipitation as a hydroxide at a pH of 3, for example, using calcite. An alternative method would be precipitating the iron as ferric sulfate using, for example, ammonium sulfate as a reactant. If the iron is not periodically removed it will eventually plate out as iron-zinc alloy. This will have no effect on the satisfactory performance of the method of this invention in respect to most uses of the product but it will be important if recovery of free zinc from the cathode is intended.

It has been noted that the conventional hot-dipped zinc coating on steel comprises three layers; a top zinc layer, an intermediate iron-zinc alloy layer, and a metallics layer, presumed to be an iron-zinc-aluminum alloy, which contacts the substrate. At higher current densities, i.e., usually greater than 500 amps/ft$^2$, usually all of these layers will be removed from the deplated side of the strip. However, at lower current densities, i.e., usually lower than 500 amps/ft$^2$, a metallics layer may remain as a loose black coating after the deplating treatment. In that event, as the strip emerges from the treatment apparatus the deplated side thereof may be subjected to a light brushing to remove the residual loose black coating. The brush selected for this purpose should be one that will not cause scarring on the surface of the strip. A brush sold by Minnesota Mining & Manufacturing Co. under the mark Scotchbrite has been found to be useful in this regard.

Referring in detail to the drawings and in particular to FIG. 1, a steel strip 10 is supplied from a coil or other source not shown. The strip is differentially coated with zinc so that the thickness of the coating on one side 11 is less than the coating on the opposite side 12. It is guided by suitable deflector rolls such as roll 9, also not shown, so that it passes into a tank 13 filled with a dilute aqueous solution, shown generally as 14, of sulfuric acid or a sulfate radical, and under sink rolls 15. The strip passes through the electrolytic solution between cathodes 16 and anodes 17 which are connected respectively to a direct current electromotive source, not shown. The cathodes, for example, may be connected to a source of direct current as a battery or to a direct current generator. It is important that the side 11 of the strip, which is the side from which the zinc coating is removed, is facing the cathodes as it passes through the electrolyte. As the strip passes between the cathode and anode, zinc is removed from the strip 11 by the reaction indicated, and may be deposited on the cathodes, hydrogen also being evolved at that point. At the anodes, zinc metal is reduced to zinc ion which goes into solution and is plated on the immediately adjacent side 12 of the strip; water dissociation at the anode is also indicated. Thus, zinc is simultaneously removed from and plated on respective sides of the steel strip. As the strip emerges from the treatment apparatus it may be subjected to subsequent treatment such as non-abrasive brushing of the deplated surface, and the like.

Figure 2:
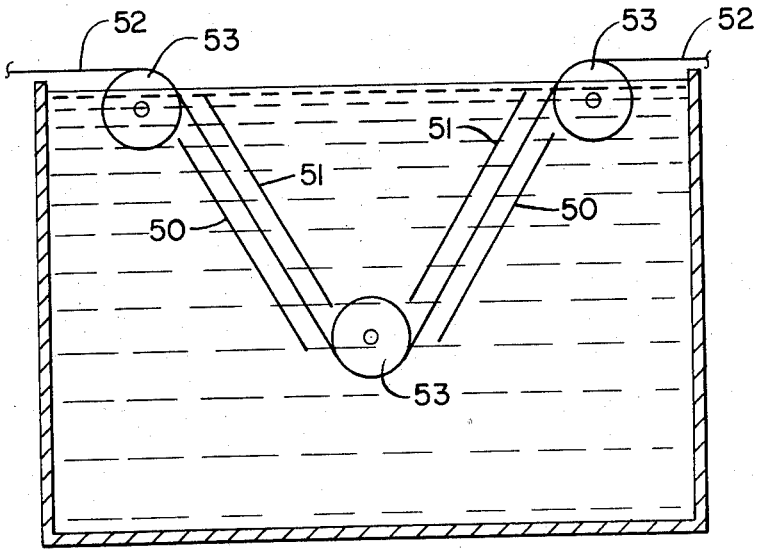
FIG. 2 is a view similar to FIG. 1 showing a modified form of the apparatus used in carrying out the invention.

FIG. 2 is a diagrammatic illustration of an alternate embodiment of the invention wherein the cathode 50 and anodes 51 are arranged in a diagonal configuration, the zinc coated strip 52 being supplied from a coil or other suitable source, not shown, and passed between the electrodes by deflector rolls 53. The operating conditions generally described above are also applicable in this embodiment.

It is, of course, possible to place at least two of the electrolytic cells described above in series which would permit speeding up of the line or the utilization of a lower current density.

As a specific example of the process of this invention, a 6 inch wide strip having a galvanized coating of 0.1 ounce/ft$^2$ on the light side and 0.5 ounces of zinc/ft$^2$ on the heavy side was introduced into an electrolytic solution, essentially in the manner illustrated in FIG. 1. The tank utilized in this case was 52 inches in length, 30 inches wide and 4 feet in depth. It contained 180 gallons to overflow of an electrolytic solution which was circulated through pipes connecting the treatment tank with a storage tank holding 200 to 300 gallons of the solution. The electrolyte was maintained at a temperature of about 135° F and was separately formulated as 530 gallons of an aqueous solution including 1,030 pounds of zinc sulfate and 25 pounds of concentrated sulfuric acid. The steel strip was passed between the anodes and cathodes, again as depicted in FIG. 1, at a line speed of 10 ft/minute. The total anode area was 1.625 sq. ft., specific dimensions being 39 inches long, 6 inches wide and 0.75 inches thick. The cathode plate had the same dimensions. The total current input in the system was 872 amps, the current density being 540 amps/ft$^2$ and the voltage being 14.5 volts. The electrodes were each spaced about 2 inches from the strip. The treated strip emerging from the tank was found to have one surface, i.e., that previously having the lighter coating, stripped free of zinc while the opposite side of the strip had a zinc coating of about 0.6 ounce/ft$^2$. The zinc surface was still spangled and brighter than the original.

The above embodiments are to be considered in all respects as illustrative and not restrictive since the invention may be embodied in other specific forms without departing from its spirit or essential characteristics. Therefore, the scope of the invention is indicated by the claims rather than by the foregoing description, and all changes which come within the meaning and range of the equivalents of the claims are intended to be embraced therein.

What is claimed is:

1. A method for treating zinc-coated metal strip material comprising:

a. immersing the strip in an electrolyte solution, b. passing the strip through the electrolyte solution and between anode means and cathode means, and c. electrolytically removing a zinc coating from the side of the strip facing the cathode means while simultaneously depositing a substantially equivalent amount of zinc on the opposite side of the strip.

2. A method as defined in claim 1 wherein the strip passing between the anode means and the cathode means is a bipolar electrode.

3. A method as defined in claim 2 wherein the strip has a zinc coating on a first side which is less than the zinc coating on the opposite side, said first side of the strip facing the cathode means as the strip passes between the cathode means and the anode means.

4. A method as recited in claim 3 wherein the zinc coating on the first side is about 0.01 – 0.15 ounce/ft$^2$ and the zinc coating on the opposite side is about 0.2 – 0.7 ounce/ft$^2$.

5. A method as recited in claim 4 wherein the electrolytic solution is an aqueous solution of zinc sulfate and sulfuric acid and contains from about 10 to 20 ounces of zinc metal per gallon of solution.

6. A method as recited in claim 5 wherein the electrolyte solution has a pH of from about 1 to 4.

7. A method as recited in claim 6 wherein the electrolyte solution is maintained at a temperature within the range of from 120° to 150° F.

8. A method as recited in claim 3 wherein the spacing between the strip and each electrode means is from about 1 to 3 inches.

9. A method as recited in claim 8 wherein the average current density on the strip opposite the cathode means ranges from about 200 to about 1,000 amps/ft$^2$.

10. A method as recited in claim 3 wherein the anode means and cathode means are arranged in a substantially diagonal configuration and the strip is passed between the anode means and cathode means also along a substantially diagonal line.

11. A method as recited in claim 10 wherein the anode means and cathode means comprise two sets of electrodes.

12. A method as recited in claim 3 wherein subsequent to the electrolytic removal of the zinc coating from the first side of the strip, the first side is subjected to a brushing treatment which does not scar the surface of the strip whereby any residual loose coating is removed.

13. A method as recited in claim 2 wherein the electrolyte solution is an aqueous solution of zinc sulfate and sulfuric acid and contains from about 10 to 20 ounces of zinc metal per gallon of solution.

14. A method as recited in claim 13 wherein the electrolyte solution has a pH of from about 1 to 4.

15. A method as recited in claim 14 wherein the electrolyte solution is maintained at a temperature within the range of from about 120° to 150° F.

16. A method as recited in claim 2 wherein the anode means and cathode means are arranged in a substantially diagonal configuration and the strip is passed between the anode means and cathode means also along a substantially diagonal line.

17. A method as recited in claim 16 wherein the anode means and cathode means comprise two sets of electrodes.

18. A method as recited in claim 2 wherein subsequent to the electrolytic removal of the zinc coating from one side of the strip, the strip is subjected to a brushing treatment which does not scar the surface of the strip, whereby any residual loose coating is removed.

19. A method as recited in claim 1 wherein the cathode means is of a material which resists the plating of metal ions tending to discharge on its surface.

20. A method as recited in claim 1 wherein the cathode means is of a material on which zinc will deposit but from which a zinc plating can be easily stripped.

21. A method as recited in claim 20 wherein the cathode means comprises a material selected from the group consisting of lead, lead alloys, carbon, platinum plated titanium and aluminum.

* * * * *

UNITED STATES PATENT OFFICE

CERTIFICATE OF CORRECTION

Patent No. 3,989,604 Dated November 2, 1976

Inventor(s) Lowell W. Austin

It is certified that error appears in the above-identified patent and that said Letters Patent are hereby corrected as shown below:

Column 1, line 59, after "having", insert -- the --;

Column 2, line 61, cancel "3.0" and insert -- 4.0, preferably 2.8 - 3.0 --;

Column 3, line 5, cancel "electolytic" and insert -- electrolytic --;

Column 4, line 54, after "wide", insert -- steel --;

Column 4, line 42, cancel "cathode", insert -- cathodes --;

Column 5, line 54, after "from", insert -- about --.

Signed and Sealed this

Twenty-ninth Day of March 1977

[SEAL]

*Attest:*

RUTH C. MASON
*Attesting Officer*

C. MARSHALL DANN
*Commissioner of Patents and Trademarks*